United States Patent [19]

Cawlfield

[11] Patent Number: 4,836,903

[45] Date of Patent: Jun. 6, 1989

[54] SODIUM HYDROSULFITE ELECTROLYTIC CELL PROCESS CONTROL SYSTEM

[75] Inventor: David W. Cawlfield, Cleveland, Tenn.

[73] Assignee: Olin Corporation, Cheshire, Conn.

[21] Appl. No.: 207,799

[22] Filed: Jun. 17, 1988

[51] Int. Cl.[4] ..... C25B 15/08; C25B 9/00

[52] U.S. Cl. ..... 204/228; 204/255; 204/257; 204/263; 204/92

[58] Field of Search ..... 204/82, 92–93, 204/96–98, 95, 257–258, 228, 263–266, 255

[56] References Cited

U.S. PATENT DOCUMENTS

| | | | |
|---|---|---|---|
| 3,680,070 | 7/1972 | Nystuen | 340/527 |
| 4,087,700 | 5/1978 | Curiger et al. | 340/679 |
| 4,212,721 | 7/1980 | Bergner et al. | 204/228 X |
| 4,387,422 | 6/1983 | Steutermann | 364/183 |
| 4,434,033 | 2/1984 | Kaczur et al. | 204/95 |
| 4,435,291 | 3/1984 | Matsko | 210/743 |
| 4,508,602 | 4/1985 | Kaczur et al. | 204/228 X |
| 4,509,618 | 4/1985 | Kuhn | 340/679 |
| 4,631,530 | 12/1986 | Gasper | 340/679 |

*Primary Examiner*—Donald R. Valentine

*Attorney, Agent, or Firm*—Ralph D'Alessandro

[57] ABSTRACT

A process control system for a filter press membrane electrochemical cell is provided that utilizes a microcomputer for multi-tasking functions to concurrently execute four programs to control the cell operation and self-correct out-of-tolerance conditions or shut cell operation down if not corrected within the allotted time period. A core process control program intercommunicates with a timer program, an alarm monitoring program and at least one sequence program in the process control system.

11 Claims, 7 Drawing Sheets

SODIUM HYDROSULFITE ELECTROLYTIC CELL PROCESS CONTROL SYSTEM

BACKGROUND OF THE INVENTION

This invention relates generally to the control of electrochemical manufacturing processes. More particularly, the present invention relates to a process control system for the operation of a sodium hydrosulfite electrolytic cell to produce concentrated hydrosulfite solutions at high current densities.

The controlled feeding of chemicals in solutions from holding tanks into reactors, process streams or treatment streams is old and well known. The simpliest techniques employ a chemical feed pump with an on/off switch and transfer lines through which move the chemical or solution. This technique requires the presence of a human operator to monitor the transfer. Electromechanical controllers have also been used to determine when chemicals for solutions should be transferred. This approach either measures a property or properties in an end-use stream or automatically times when a desired chemical should be fed. Sensors detect either the proper time or the measured property and generate a signal to initiate pumping action. the pumping action is ceased when the measured property has changed to a desired level or a predetermined time has expired. This approach reduces the need for constant human monitoring, but does not necessarily monitor the actual operation of the feed pump should a feed pump fail for any of a variety of reasons. Later generation controllers have monitored a multiplicity of chemical processes. Controllers add a multiplicity of adjustors or actuators to adjust the control process parameters simultaneously with the monitoring. Alarms are provided whenever the adjustors fail to be self-correcting.

A more specialized problem occurs when attempting to provide alkali metal hydrosulfite solutions to industrial customers via on-site production, as opposed to a large centralized production facility that employs shipment of the product to remote using sites. On-site production of the desired product reduces shipping costs, but the economic advantage decreases because of the loss of economy of scale obtained when producing the product in large electrochemical facilities. This advantage is also decreased because of the increased manual labor required to operate several on-site production facilities.

The commercial electrolytic production of alkali metal hydrosulfite solutions presents even more system specific challenges. The product must be produced with a consistent composition at varying rates of production to match demand. To accomplish this, the physical and chemical properties of process streams within the electrolytic cell must be carefully controlled. In the event of equipment failure at the remote operating sites, the required sequence of shutdown steps must be taken quickly to avoid damage to the process equipment and the environment, as well as to protect the human operators. The production system must have some method to permit remote access to the system control if the production facilities will be operated at a number of remote locations on the sites where the product alkali metal hydroxide solutions are used.

These inherent disadvantages and problems can be overcome by the use of a process control system which achieves total process control with a single microcomputer that is used to perform multiple functions which permit automatic decision making and process adjustment or shutdown to occur without the need for the presence of a local operator.

SUMMARY OF THE INVENTION

It is an object of the present invention to provide a total process control system for the operation of an electrolytic cell.

It is another object of the present invention to provide a totally automatic process control system for the operation of an electrolytic cell that is low cost and permits critical core functions to be accomplished to self-correct out-of-tolerance operating conditions and, if uncorrected within the allotted time, to safely bring the cell to a shutdown condition.

It is a feature of the present invention that a separate timer program in the process control system sends a special message to the core process control program that is given a higher priority than other messages so that the timer message is always received and processed fist to permit performance of essential core control functions only upon receipt of the special message.

It is another feature of the present invention that the timer program permits the core process control program to periodically perform control functions, including computations and gather input from transmitters.

It is another feature of the present invention that a monitor program initiates an alarm system for out-of-tolerance process parameters and a sequencer program which initiates calculations to self-correct the out-of-tolerance conditions.

It is still another feature of the present invention that the process control system uses enhanced synchronized message passing to effect the transfer of information among the programs in the control system.

It is a further feature of the present invention that several programs run at one time in the process control system to automatically control the operation of the alkali metal hydrosulfite electrolytic cell.

It is an advantage of the present invention that the process control system is highly flexible and that it is low in cost.

It is another advantage of the present invention that remote operations of alkali metal hydrosulfite electrolytic cells is possible and that such operation is reliable.

It is still another advantage of the present invention that disablement in the alkali metal hydrosulfite process control system occurs only during the core control functions so that the corruption of memory in the central processing unit is avoided.

These and other objects, features and advantages are obtained in the process control system for the operation of an alkali metal hydrosulfite electrolytic cell that utilizes enhanced synchronized message passing to perform the core process control functions and assign priority over other lower level control functions in the operation of the electrolytic cell. The process control system senses the operating conditions and automatically adjusts them to correct out-of-tolerance conditions. This permits continuous cell operation to occur or automatically shuts down the operation of the cell in a safe manner so the cell, the surrounding environment and any personnel are not harmed if the automatic adjustments do not correct the out-of-tolerance condition within a programmed reaction time period.

BRIEF DESCRIPTION OF THE DRAWINGS

The objects, features and advantages of the present invention will become apparent upon consideration of the following detailed disclosure of the invention, especially when it is taken in conjunction with the accompanying drawings wherein.

DETAILED DESCRIPTION OF THE PREFERRED EMBODIMENT

While the instant process control system will be described specifically in terms of a filter press membrane sodium hydrosulfite electrolytic cell, it is to be understood that in its broadest applications the process control system can be used to control any electrolytic cell operation, such as a filter press membrane chlor-alkali or potassium hydroxide cell.

The Cell

Figure 2:
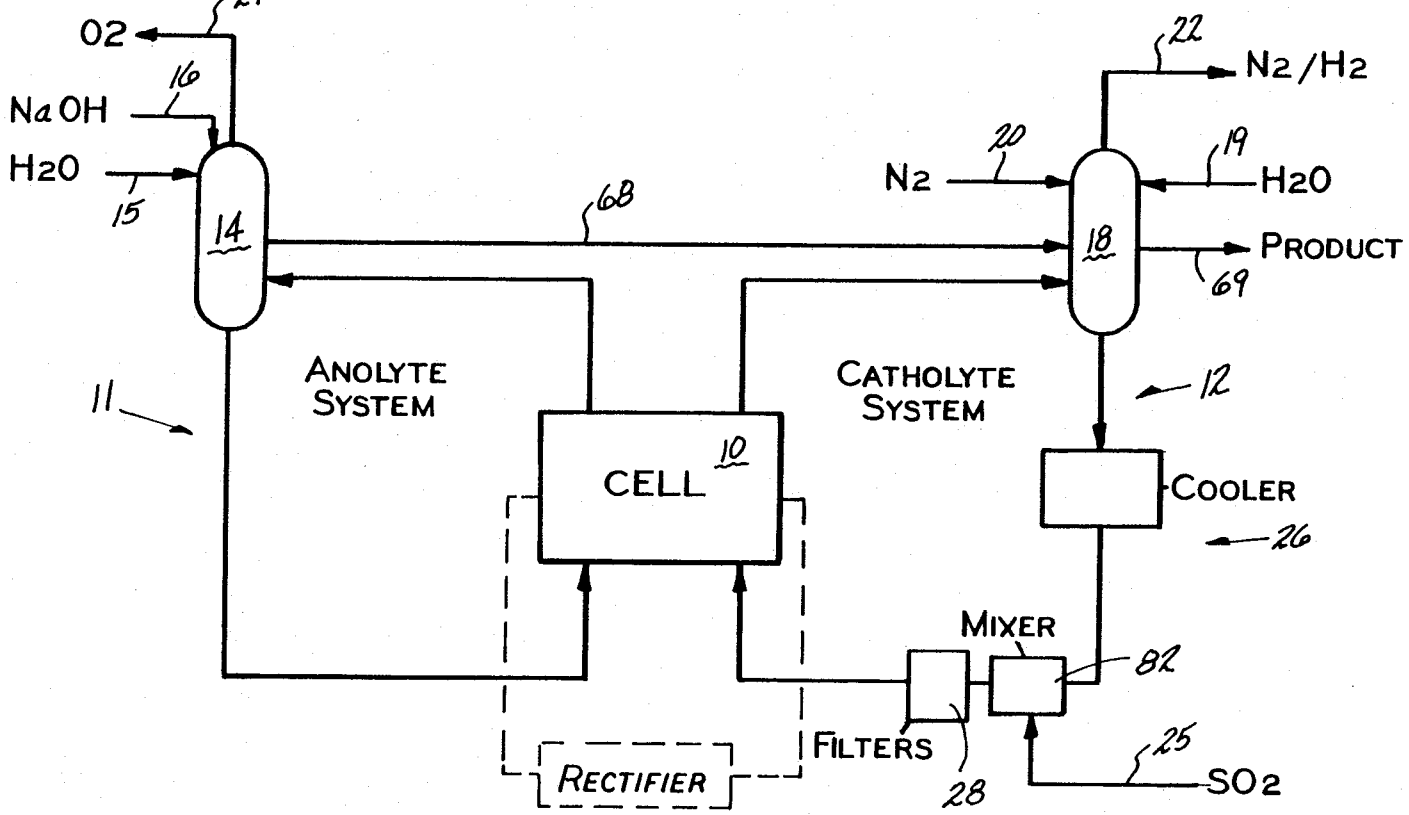
FIG. 2 is a diagrammatic illustration of the flow systems in an alkali metal hydrosulfite electrolytic cell system using the instant process control system.

The electrolytic cell 10 is diagrammatically illustrated in FIG. 2 having an anolyte system 11 and a catholyte system 12. The anolyte system 11 has a disengager 14 into which is fed deionized water and caustic by feed lines 15 and 16, respectively. The catholyte system 12 similarly has a disengager 18 with a deionized water feed line 19 and a nitrogen gas feed line 20 to create a pressure pad. Oxygen is vented from the anolyte disengager 18 through vent line 21, while nitrogen is vented from the catholyte disengager 18 through nitrogen vent line 22. Dilute caustic is supplied to the catholyte system 12 via anolyte caustic overflow line 68.

The catholyte system 12 has an $SO_2$ supply line 25 that supplies the $SO_2$ necessary to combine with the dilute caustic to from the alkali metal bisulfite that is reduced electrolytically at the cathode, as will be described hereafter. An appropriate cooling system 26, such as an ethylene glycol based system, is provided to keep the catholyte and the product sodium hydrosulfite at a sufficiently low temperature to control decomposition. Filters 28 are provided downstream of the $SO_2$ inlet to prevent impurities from clogging the flow system.

Figure 1:
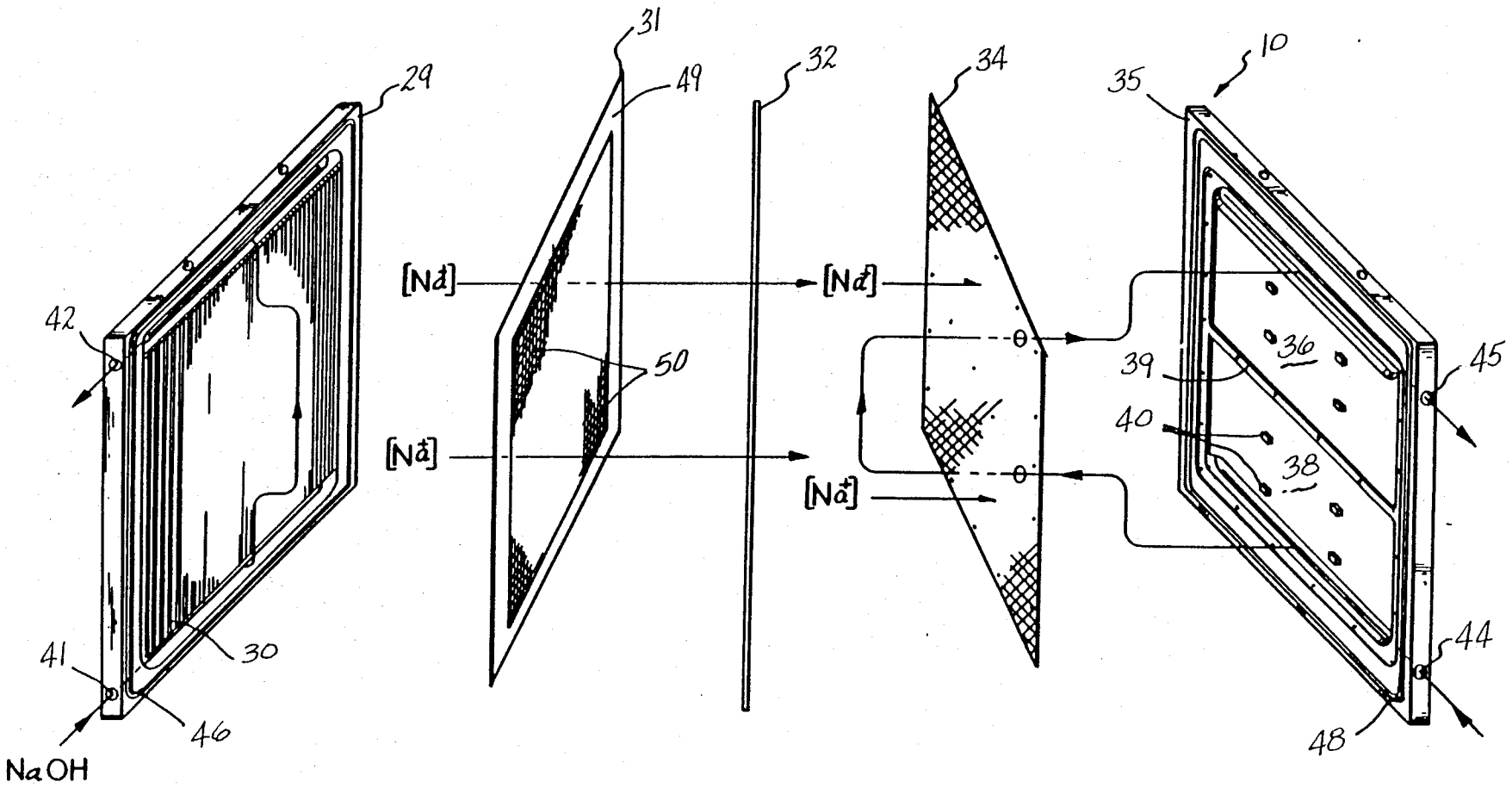
FIG. 1 is an exploded perspective view of an adjacent anode and cathode backplate and the intermediate structure in an alkali metal hydrosulfite electrolytic cell.

FIG. 1 shows the intermediate structure between adjacent anode and cathode backplates of the cell 10 in an exploded and partially diagrammatic illustration. The cell 10 consists of an anode backplate 29 with anode rods 30 welded at their tops and bottoms to the backplate. A plastic separator mesh 31, a cation permselective membrane 32, a porous cathode plate 34 and cathode backplate 35 complete the cell 10. The cathode backplate 35 has an upper chamber 36 and a lower chamber 38 separated by a cathode flow barrier 39, which interrupts the vertical flow of catholyte upwardly and forces the catholyte fluid to flow in the path shown in FIG. 1 through the porous cathode plate 34. The porous cathode plate 34 is mounted to the backplate 35 via cathode support pedestals 40.

The plastic separator mesh 31 is formed from any material resistant to anolyte corrosion and preferably polypropylene has been employed. An 8 mesh polypropylene fabric with an approximately 40% open area has been successfully employed, as has a titanium dioxide filled polyethylene mesh. The separator means 31 has a separator frame 49 that is solid about the periphery and a separator mesh 50 on the interior of the separator frame 49. The mesh 50 is treated with a hydrophilic coating, such as titanium dioxide, to prevent gas bubbles from adhering to the mesh and the adjacent membrane by capillary action. Preventing the buildup of gas bubbles on the membrane and in the mesh avoids cell voltage fluctuations during operation.

The anode backplate 29 has an anolyte entry port 41 and an anolyte exit port 42. Similarly, the cathode backplate 35 has a catholyte entry port 44 and a catholyte exit port 45. These ports carry the anolyte and catholyte, respectively, into and out of the anode and cathode chambers.

Gasket grooves 46 and 48 are machined into the anode and cathode backplates 29 and 35, respectively, to permit the cell 10 to be assembled in a fluid-tight configuration. Gaskets of $\frac{3}{8}''$ round EPDM, ethylene-propylene-diene monomer, have been used to effect the fluid-tight sealing.

The anode has been designed so that the anolyte which is electrolyzed in the cell 10 is any suitable electrolyte which is capable of supplying alkali metal ions and water molecules to the cathode compartment. Suitable as anolytes are, for example, alkali metal halides, alkali metal hydroxides, or alkali metal persulfates. The selection of anolyte is in part dependent on the product desired. Where a halogen gas such as chlorine or bromine is wanted, an aqueous solution of an alkali metal chloride or bromide is used as the anolyte. Alkali metal hydroxide solutions are chosen where oxygen gas or hydrogen peroxide is to be produced. If persulfuric acid is the desired product, an alkali metal persulfate is employed. However, alternate materials of construction, such as titanium group metals for the anolyte wetted parts with an alkali metal chloride anolyte, would be necessary for each particular anolyte utilized.

In any case, concentrated solutions of the electrolyte selected are employed as the anolyte. For example, where sodium chloride is selected as the alkali metal chloride, suitable solutions as anolytes contain from about 12 to about 25 percent by weight of NaCl. Solutions of alkali metal hydroxides, such as sodium hydroxide, contain from about 5 to about 40 percent by weight of NaOH.

The cell 10 preferably has been operated with caustic soda. Where caustic soda (NaOH) is used, water and the caustic soda enter through anolyte distribution slots (not shown) and the solution flows along the high velocity flow path between the adjacent anode rods 30 and the anode inter-rod gaps at the rear of the anolyte compartment toward the top of the cell. Most of the anolyte fluid volume flow occurs between the anode rods 30 and within the hydrophilically treated separator mesh 31. The sodium ions migrate across the membrane, being produced as a result of the electrolysis reaction forming oxygen, water and sodium ions, $$4NaOH \rightarrow O_2 + 4Na^+ + 2H_2O + 4e^-.$$

Depleted caustic passes out with oxygen and water through the anolyte exit ports 42 to the disengager 14.

The monolithic nature of the electrode is evident since it is machined from a solid stainless steel plate. Since the cell is bipolar, the cathode is on one side of the stainless steel plate on the cathode backplate 35 side, while the anode backplate 29 and the anode is on the opposing side.

The cathode plate 34 is a highly porous multilayer structure. It comprises a support layer formed of perforated stainless steel. This support layer forms the mounting base and protects the innermetal fiber felt layer that is formed of, for example, 15% dense, very fine 4 to 8 micron fibers and 15% dense 25 micron fibers laid on top of one another. A wire screen of, for example, 18 mesh with a 0.009 inch wire diameter is then placed atop the fiber felt to form a cathode that has a porosity of preferably between 80 and 85%. The cathode plate 34, thus, is a four layered sintered composite with all of the materials made of stainless steel, preferably 304 or 316 steel, and in the appropriate sheet size. The highly effective surface area of cathode plate 34 is achieved by the use of low density metal felt formed from very fine elements.

Reduction occurs at the cathode in the cell 10 by the electrolysis of a buffered aqueous solution of an alkali meta bisulfite. A typcial reaction is as follows:

$$4NaHSO_3 + 2e^- + 2Na^+ \rightarrow Na_2S_2O_4 + 2Na_2SO_3 + 2\text{-}H_2O.$$

Depleted caustic and sulfur dioxide are mixed to form $NaHSO_3$ that is fed into the cathode chamber 38 via the catholyte entry port 42. This catholyte liquid then rises vertically upwardly until it passes out through the cathode plate 34. The cathode flow barrier 39 acts as a block to the straight vertical flow of the catholyte fluid upwardly from the lower cathode chamber 38 into the upper cathode chamber 36. The catholyte fluid then passes through the cathode plate 34 and continues flowing upwardly through the cathode-membrane gap until it passes the cathode flow barrier 39. At this point the catholyte fluid passes back through the highly porous cathode plate 34 into the upper cathode chamber 36 and then into a catholyte collection groove. The cell product solution containing $Na_2S_2O_4$ (dithionite) exits the cell 10 through the catholyte exit ports 45.

A buffer solution containing from about 40 to about 80 gpl of bisulfite is utilized with the catholyte solution because of sodium thiosulfate formation resulting from the reduction and decomposition of hydrosulfite (dithionite) and the pH change of the catholyte as bisulfite is consumed and sulfite is formed according to the reaction $$Na_2S_2O_4 + 2e^- + 2Na^+ + 2NaHSO_3 \rightarrow Na_2S_2O_3 + \text{-}2Na_2SO_3H_2O.$$

For example, where sodium hydrosulfite is produced for commercial sale, the solutions contain from about 120 to about 160 grams per liter. However, since the alkali metal hydrosulfite solutions sold commercially are usually diluted before use, these dilute aqueous solutions can alos be produced directly by the process.

Current densities of at least 0.5 kiloamperes per square meter are employed. Preferably the current density is in the range of from about 1.0 to about 4.5, and more preferably at from about 2.0 to about 3.0 kiloamperes per square meter. At these high current densities, the electrolytic cell 10 operates to produce the required volume of high purity alkali metal hydrosulfite solution which can be employed commercially without further concentration or purification.

The electrolytic membrane cell 10 employs a cation exchange membrane between the anode and the cathode compartments which prevents any substantial migration of sulfur-containing ions from the cathode compartment to the anode compartment. A wide variety of cation exchange membranes can be employed containing a variety of polymer resins and functional groups, provided the membranes possess the requisite sulfur ion selectivity to prevent the deposition of sulfur inside the membranes. Such deposition can blind the membranes, the result of sulfur species diffusing through the membranes and then being oxidized to create acid within the membranes that causes hydrosulfite and thiosulfate to compose to sulfur in acidic conditions. This selectivity can be verified by analyzing the anolyte for sulfate ions.

Suitable cation exchange membranes are those which are inert, flexible, and substantially impervious to the hydrodynamic flow of the electrolyte and the passage of gas products produced in the cell. Cation exchange membranes are well-known to contain fixed anionic groups that permit intrusion and exchange of cations, and exclude anions, from an external source. Suitable cation exchange membranes are sold commercially by E. I. DuPont de Nemours & Co., Inc. under the trademark "Nafion", by the Asahi Chemical Company under the trademark "Flemion", and by the Asahi Chemical Company under the trademark "Aciplex". Perfluorinated sulfonic acid membranes are also available from the Dow Chemical Company.

Process Control System

The operation of the cell 10 with its anolyte system 11, catholyte system 12 and its product flow system is controlled by a process control system that uses a single microcomputer to execute multiple programs concurrently in an enhanced synchronous message passing system between programs based on messages of differing priorities. This particular process control system integrates a core process control program, an alarm monitoring program, a timer program, and one or more sequencing programs.

One program performs core process control functions. The core process control program performs functions that include the sequential processing of analog data input and filtering, output calculations performed by combinations of proportional, integral, feed forward and derivative modes, digital output, and alarm activation and deactivation. These functions assure maintenance of product quality by maintaining the catholyte pH in the range of about 5.3 to about 5.8, control the cell's current, control the raw material (deionized water, caustic and sulfur dioxide) feed rates, control product alkalinity based on its conductivity, and control the product concentration based on its density measured by a densometer using vibrational frequency measurements. The core process control program also transmits output instructions to actuators, for example, to change the position of flow control valves. In this priority processing system, core process control functions are performed before processing messages from other programs.

The cell is protected by an alarm monitoring system whereby a program acts as an intelligent controller through the microcomputer to receive new alarm signals from the core process control program, recognize alarm patterns, remember steps previously taken, choose an appropriate repsonse and decide when to act independently of any human operator input. The alarm monitoring system also starts or terminates the sequencer program. This will be explained in conjunction with the catholyte system where the cathode must be protected during cell shutdowns from corrosion caused by too acidic, or too low of a pH, catholyte.

A timer program sends high priority signals to the core process control program to periodically activate core control functions. It activates the sequencer after specified intervals and tells the alarm monitoring program the current time.

One or more sequencer programs are provided to send control commands to the core procress control program. The sequencer programs, when read into the microprocessor upon command by the alarm monitoring program, also send messages to the timer program to wait for the desired time interval, here arbitrarily and optimally selected as 5 minutes, to elapse during which the core process control program is initiating self; correcting actions to remedy out-of-tolerance process conditions. If these out-of-tolerance conditions are corrected within this time period, the alarm monitoring system detects the alarm condition has been cleared and stops the cell shutdown procedure. If these out-of-tolerance process conditions are not corrected within this time frame, the alarm monitoring system does not intervene and the cell shutdown procedures continue. This is accomplished by a timed response that sets all controlled outputs to a safe state by phased steps to ultimately turn off the rectifier supplying electrical current to the cell, shut off the feed of raw materials and shutdown product flow. The rectifier is shutdown gradually to permit some current to continue flowing to the cathodes to protect against corrosion until the pH of the catholyte has been elevated by the addition of caustic to a safe level.

A watchdog timer circuit is integrated into the process control system to ensure the safety of the cell operators and the environment by detecting microcomputer failure. When such a failure occurs, the rectifier is turned off and the flow of raw materials and product is stopped immediately and independently of the microcomputer.

Independent safety devices outside of the process control system protect the sulfur dioxide and caustic storage and delivery system, the electrical circuitry and the cooling or refrigeration system.

Anolyte System

The anolyte system 11 is controlled by the operator initially setting the desired flow rate set points of the deionized water and caustic into the anolyte system 11. This is based upon the desired production rate of product, which in this instance is sodium hydrosulfite. The computer then sets the value via an actuator on the flow control valve on the anolyte deionized water feed line 15 to achieve the desired flow rate into the anolyte disengager 14. The same procedure is followed for caustic to obtain the proper setting for the flow control valve on the caustic feed line 16. The flow rate of the anolyte through the anolyte system is thereafter controlled by flow sensing received from the anolyte circulation control loop by the microcomputer's process control program. These sensings cause the microcomputer to send a signal to actuators to open or close the flow control valve in the anolyte system 11.

Figure 3:
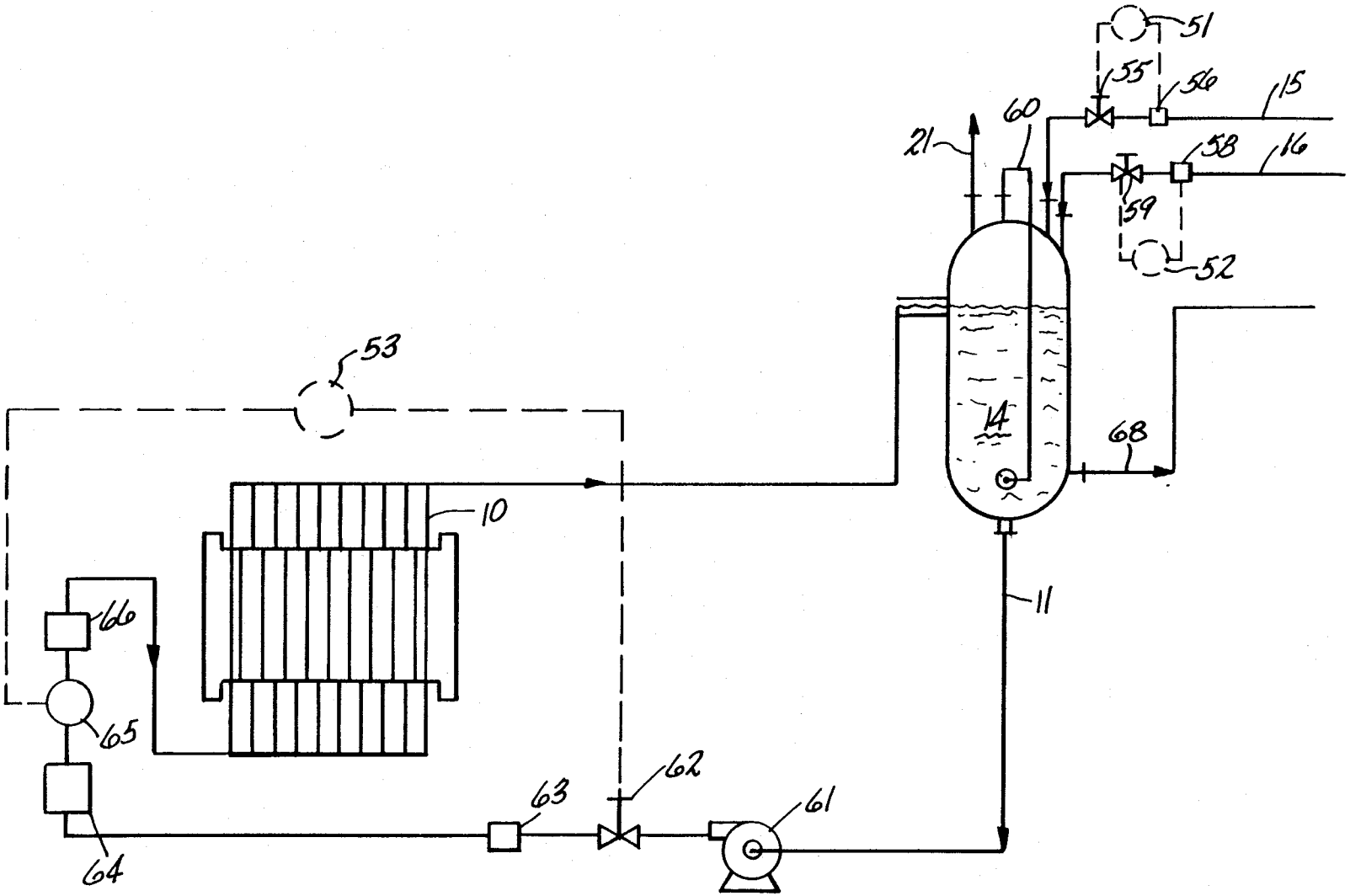
FIG. 3 is a diagrammatic illustration of the control loops and the flow loops in the anolyte system of the alkali metal hydrosulfite cell system using the instant process control system.

FIG. 3 shows the flow loop of the anolyte system 11 with the location of the sensors or transmitters, actuators or controllers and indicators. Control loops exist within the core process control program to monitor and control the anolyte circulation through the anolyte system 11, the anolyte deionized water flow and the caustic flow into the anolyte system 11. The following is a list of the sensors that supply data to the microcomputer's core process control program with the upper and lower limits that are programmed to initiate alarm signals and the self-correcting actuator signals to correct the out-of-tolerance conditions. The anolyte flow and the caustic feed flow must be corrected within a predetermined time sequence, in this instance 5 minutes, or a second set of signals initiates safe shutdown of the operation of the cell 10. In this instance the actuators are pneumatically driven, although any suitable power source could be used such as electric solenoids or hydraulics.

| | Limit 1 | Limit 2 |
|---|---|---|
| Anolyte pressure gauge 66 (psi) | 6 | 2 |
| Anolyte temperature gauge 65 (°C.) | 40 | 10 |
| Anolyte flow meter 65 (gal./min.) | 359 | 50 |
| Anolyte densometer (65 gm/cc) | 1.3 | 1.05 |
| Caustic feed flow meter 59 (lb./min.) | 5.8 | 0.5 |
| Deionized water flow meter 56 (lb./min.) | 2.8 | 0.1 |

The anolyte circulation control loop to control circulation through the anolyte system 11 is primarily controlled by the anolyte circulation flow control valve 62 that is pneumatically opened and closed based on instructions given by the core process program in response to the sensed conditions at the mass flow sensor 65 in FIG. 3. Sensor 65, an easily commercially available meter, measures flow rate, density based on frequency vibrations imparted by the anolyte, and temperature. Pressure gauges 63 and 66 measure pressure on the upstream and downstream sides of the filter 64 to detect filter clogging, where filters are utilized, prior to the anolyte's entering the cell 10.

Output from the cell 10 flows into the anolyte disengager 14, which has an oxygen vent 21 and a level gauge loop 60 which permits the level of anolyte in the disengager to be monitored. Flow control valves 55 and 59 are set in the desired position to control the flow of deionized water in the feed line 15 and anolyte caustic in feed line 16, based on the desired set points and the flow recorded through low meters 56 and 58, respectively. Anolyte is force circulated through anolyte system 11 by circulation pump 61. Overflow anolyte can exit the anolyte disengager 14 through overflow line 68 which flows into the catholyte disengager 18 of FIGS. 2 and 4.

Control loops 51, 52 and 53 provide data to the core process control program to permit the anolyte deionized water flow rate, anolyte caustic flow rate and the anolyte flow rate, respectively to be monitored and automatically controlled within the desired set points. Each flow meter 56, 58 and 65 provides flow data or monitorings in analog form that are translated into digital language and sent to the core process control program in the microcomputer which conducts calculations in the control loops 51, 52 and 53 to self-correct deviations of the flow rates from the desired set points by sending messages back to the actuators, in this instance flow control valves 55, 59 and 62, to adjust the valve positions to change the flow rates. These messages back to the actuators are converted from digital to analog form by digital to analog conversion boards. The values are the result of the aforementioned output calculations performed by the core process control program utilizing at least proportional algorithm functions.

Catholyte System

Figure 4:
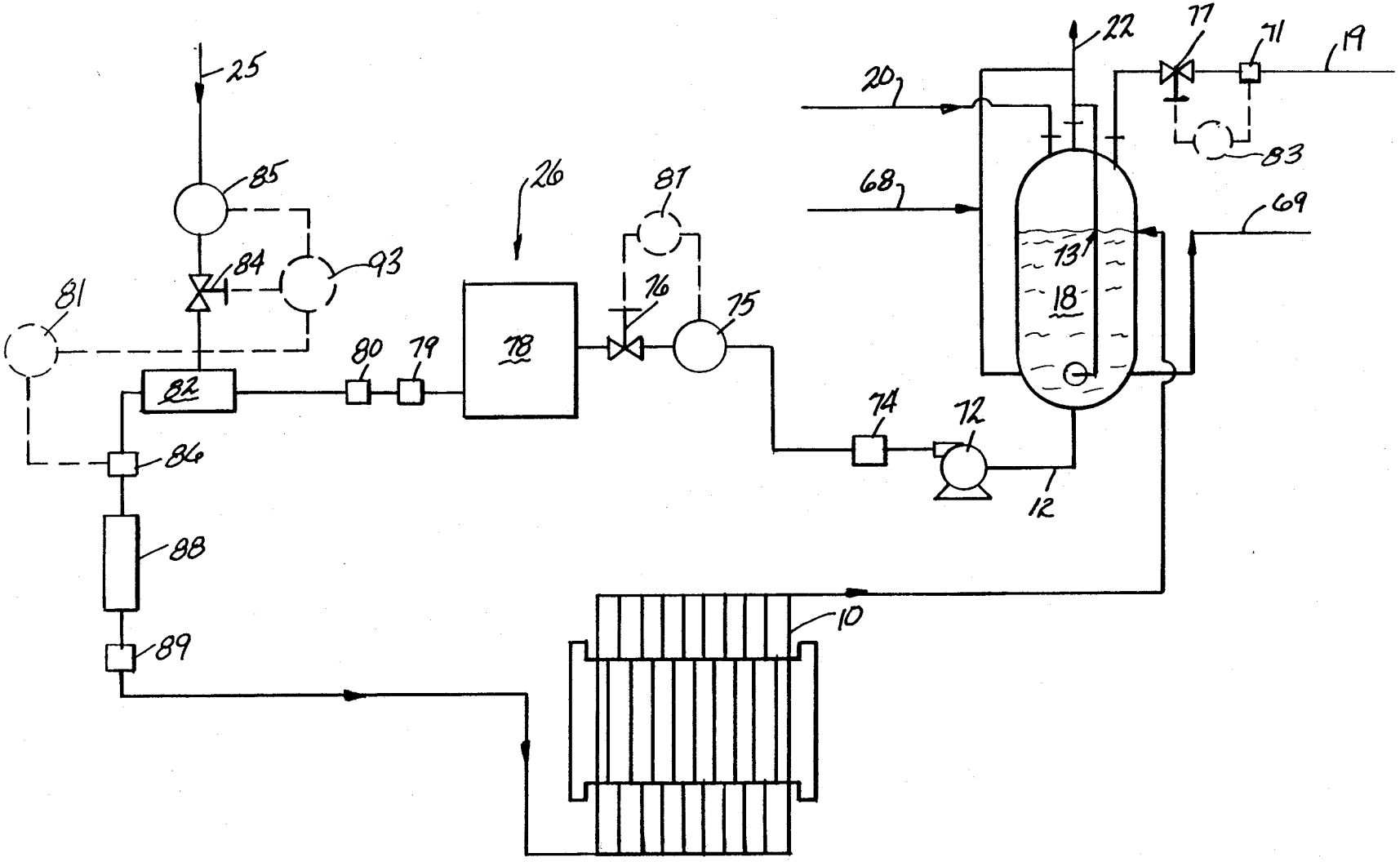
FIG. 4 is a diagrammatic illustration of the control loops and the flow loops in the catholyte system using the instant process control system.

The catholyte system 12 flow loop is shown in FIG. 4 and is controlled by the operator selecting the flow rate set point for the deionized water feed line 19 into the catholyte disengager 18 based upon the desired production rate, which is a factor of the amount of current supplied to the rectifier of FIG. 2 for the cell and is calculated by an algorithm. Control loops exist within the core process control program to monitor and control the catholyte pH, the catholyte deionized water flow, the catholyte temperature and the sulfur dioxide ($SO_2$) flow.

The following is a list of the sensors that supply data to the microcomputer's core process control program with the upper and lower limits that are programmed to initiate alarm signals and the self-correcting actuator signals to correct the out-of-tolerance conditions. The deionized water flow, catholyte pH and the catholyte temperature at gauge 75 must be corrected within a predetermined time sequence, in this instance 5 minutes, or a second set of signals initiates a safe shutdown of the operation of the cell 10. Again, as with the anolyte system 11, the actuators are pneumatically driven, although other suitable power sources previously identified could be employed.

| | Limit 1 | Limit 2 |
|---|---|---|
| Catholyte deionized water flow meter 71 (lb./min.) | 20 | 3 |
| Catholyte temperature gauge 75 (°C.) | 35 | 10 |
| Catholyte flow meter 75 (gal./min.) | 50 | 0 |
| Catholyte circulation pressure gauge 79 (psi) | 30 | 5 |
| Catholyte temperature gauge 80 (°C.) | 35 | 5 |
| Catholyte pH after $SO_2$ 86 | 7 | 4.3 |
| $SO_2$ flow meter 85 (lbs./min.) | 4 | 0.1 |
| Catholyte pressure gauge 89 (psi) | 15 | 1 |

The sulfur dioxide flow rate into the catholyte in a static mixer 82 downstream of the cooler 78 is set based on the set point of the cascade pH controller 81 and the sensings of the pH meter 86 downstream of the static mixer 82 by an acutator setting the flow control valve 84 to the proper position within the sulfur dioxide flow loop. When the pH is sensed as being too high, more $SO_2$ is allowed to flow. When the pH is sensed as being too low, less $SO_2$ is allowed to flow. The mixed $SO_2$ and catholyte pass through filters 88 to remove impurities and then pass into the cell 10 where the electrolytic reaction occurs and the product sodium hydrosulfite is produced. The product sodium hydrosulfite and the other catholyte fluids then pass into the catholyte disengager 18. Transmitters and pressure gauges 79 and 89 record the pressure in the flow loop upstream and downstream of the static mixer 82 and the filters 88 to detect any clogging of the filters that may occur due to $SO_2$ impurities and transmit the pressures to the microcomputer controlling the process.

The disengager 18 is the confluence of a number of flow streams. Deionized water line 19 feeds in through flow control valve 77 based on the desired set point and the flow is measured by flow meter 71.

Anolyte disengager overflow line 68 feeds into the disengager 18 via flow loop 67. Nitrogen gas feed line 20 pressurizes the vessel, while vent line 22 permits trace amounts of hydrogen generated during the electrochemical process and nitrogen gas to vent from the system. A disengager level gauge in leve loop 73 monitors the level of catholyte in the disengager 18. Product exits the disengager 18 through outlet line 69 to a product storage tank 90 seen in FIG. 5.

Catholyte exits the catholyte disengager 18 into the catholyte system 12 and is force circulated by pump 72. The pressure in the catholyte system 12 downstream of the pump is measured by pressure gauge 74, while the flow rate, temperature and density of the catholyte is measured by sensor 75, a readily commercially available mass flow meter. The catholyte temperature is controlled by being circulated through a heat exchanger or cooler 78, which is part of the cooling system 26. Cooler 78 is preferably glycol cooled through glycol supply and drain lines (not shown) that is regulated by a flow control valve (also not shown) on the supply line. Flow of catholyte through the cooler 78 is regulated by pneumatic positioning of the actuator flow control valve 76 in response to sensings from sensor 75 of the flow rate. Pressure gauge and transmitter 79 and temperature gauge and transmitter 80 monitor those parameters and send signals to the core process control program for the catholyte flow downstream of the cooler 78.

The flow rate of the catholyte through the catholyte system is controlled by flow sensings received from the microcomputer's core process control program. These sensings send a signal to the actuators to open or close the flow conrol valves in the catholyte through control loops 83, 87 and slave control loop 93.

Control loops 83, 87 and slave control loop 93 provide the data to the core process control program to permit the catholyte deionized water flow rate, the catholyte flow rate and the $SO_2$ flow rate, respectively, to be monitored and automatically controlled within the desired set points. Each flow meter 71, 75 and 85 provides flow data or monitorings in analog form that are translated into digital language and sent to the core process control program in the microcomputer. The microcomputer conducts calculations in the control loops 83, 87 and slave control loops 93 to self-correct deviations of the flow rates from the desired set points by sending messages back to the actuators, in this instance flow control valves 76, 77 and 84, to adjust the valve positions to change the flow rates. These messages back to the actuators are converter from digital to analog from by digital to analog conversion boards (not shown). The values are the result of the aforementioned output calculations performed by the core process control program utilizing at least proportional algorithmic functions. Cascade pH control loop 81 is the master control loop that has a slave control loop 93 to which it supplies an output flow rate which becomes the new set point for flow control valve 84 based on the input of pH meter and transmitter 86 and the result of the algorithm calculation it performs as a part of the core process control program. Control loop 93 adjusts the position of flow control valve 84 so the output sensing of flow meter 85 matches the desired set point. More or less $SO_2$ is added as previously described.

Product System

Figure 5:
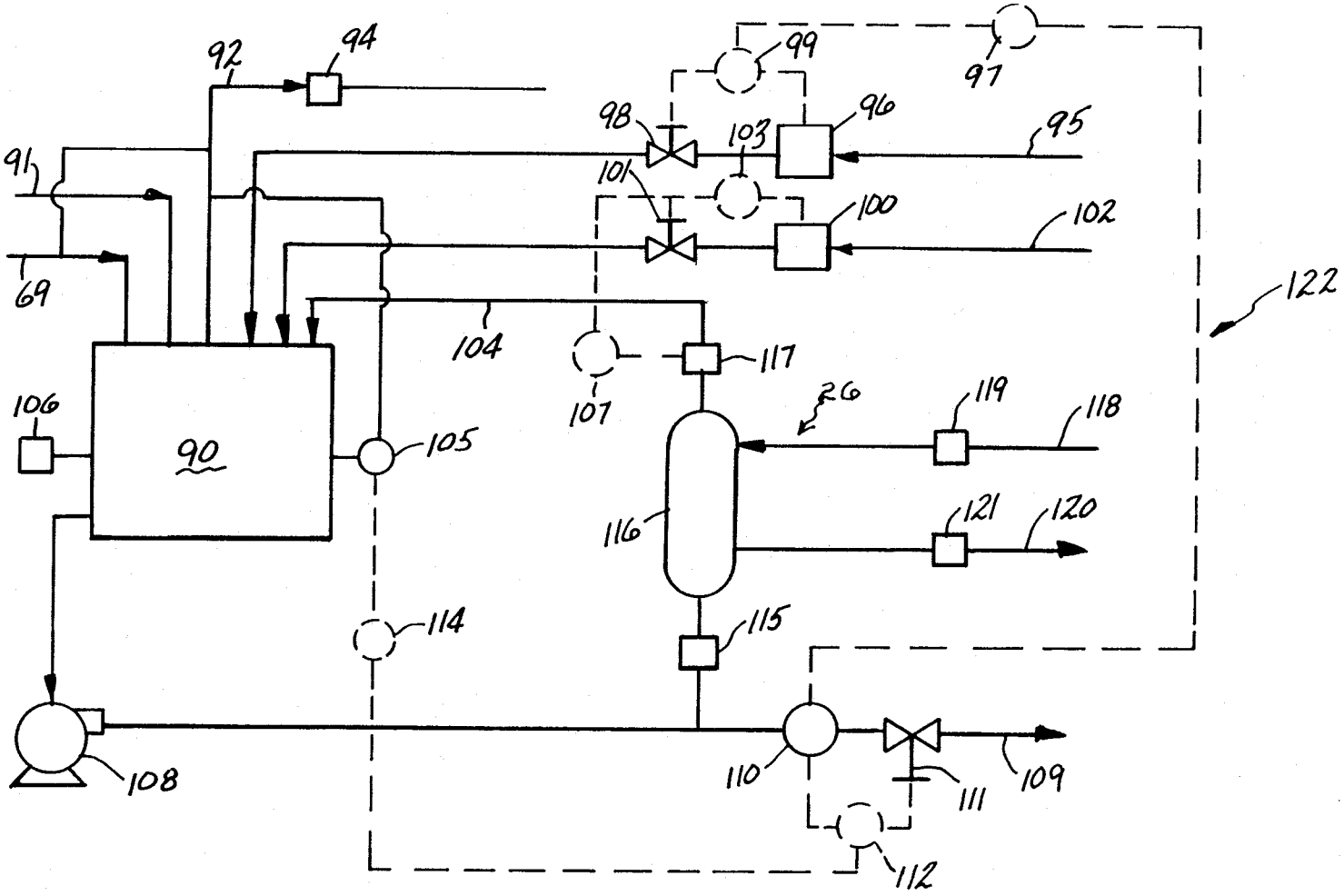
FIG. 5 is a diagrammatic illustration of the control loops in the product system using the instant process control system.

The product system 122 flow and control loop is shown in FIG. 5 and has the product storage tank 90 as the focus of the flow and control loops. Deionized water feed line 95 supplies water to the product tank to control the product's density. Caustic feed line 102 supplies caustic to stabilize the product and control product decomposition. Tank 90 is pressurized by a gas feed line 91, such as with nitrogen, and has a gas vent line 92, whose pressure can be monitored by pressure gauge 94. Catholyte overflow line 69 also feeds into the product storage tank 90. Circulation within the product system 122 is provided by product circulation line 104, which exits from and returns into tank 90. The level of liquid product, such as the sodium hydrosulfite in this instance, is monitored by a product tank level gauge and transmitter 105.

Both the catholytic overflow line 69 and the level gauge 105 and its loop are provided with siphon breaks into the vent line 92. A product temperature gauge 106 is provided to monitor the temperature of the product in the tank 90. Both the deionized water feed and the caustic feed lines 95 and 102, respectively, are controlled by cascade control loops with two individual control loops based on sensor readings. The cascade control loops in each instance have a slave loop that signals an acutator, a pneumatic flow control valve in these instances, based on a master control loop that monitors either conductivity or density at another point in the product flow system 122. Specifically as illustrated in FIG. 5, deionized water flow in feed line 95 is monitored by flow meter and transmitter 96. Control loop 99, which is part of the core process control program in the microcomputer, receives the signal from flow meter and transmitter 96 and compares the actual flow with the desired set point flow. It then sends a message to the actuator flow control valve 98 to adjust the position of the valve to correct the flow rate. The sensing message and the actuator message are sent in analog, but are converted to digital for the flow rate, and from digital for the actuator by analog to digital conversion boards (not shown). Control loop 99 is the slave loop, which is controlled by the master control loop 97 that receives the density monitorings from the product flow, temperature and density meter 110. From an optimum set point, for example about 1.78 grams per cubic centimeter, an algorithm calculation is done to determine the set point for flow control valve 98 and which is inputted in control loop 99 in the core process control program to achieve the desired set point and product density. This is a continuously self-correcting system, so that if the product density is too high, more deionized water is added to the product tank 90 and vice versa.

The caustic feed line 102 has a similar slave control loop 103 that receives sensings from the caustic flow meter and transmitter 100. Based on these sensings, which are similarly converted from an analog to digital, the core process control program's slave control loop 103 controls the flow rate between the predetermined limits independent of the master control loop 107. However, the master control loop 107 receives sensings from conductivity sensor 117. Based on the input of sensor 117 and the result of the algorithm calculation performed by the core process control program's master control loop 107, the slave control loop 103 is supplied a flow rate which becomes its new set point. Control loop 103 adjusts the position of the flow control valve 101 so that the output sensing of flow meter 100 matches the desired set point. If the conductivity is too low, more of the about 50% concentrated caustic is added to the product in the product tank 90, or vice versa, so that the system is continuously self-correcting. The optimum conductivity, for example, can be about 108 millisiemens.

Another cascade control loop exists to control the level of product in the product tank 90 by controlling the flow of product through the product flow line 109 to the product storage system (not shown). A slave product flow controller loop 112 receives the product flow sensing from the product flow, density and temperature meter and transmitter 110. From the optimum flow rate set point the slave control loop 112 in the core process control program independently positions the flow control valve 111 based on the analog sensings from sensor 110, which are converted into digital in the same manner as previously described. However, master control loop 114 in the core process control program responds to the analog converted to digital level sensing of the product in the tank 90 by the product level gauge and transmitter 105 to supply the new set point to slave loop 112 as previously described and to thereby determine the setting of flow control valve 111.

The temperature of the product is monitored by sensor 110 as the product is force circulated about product flow system 122 by product circulation pump 108. The product temperature is also monitored in tank 90 by the previously mentioned temperature gauge and transmitter 106. The product is kept at the proper temperature by product cooler or heat exchanger 116 which is fed by a coolant supply or feed line 118 and an exit line 120. Coolant temperature gauges and transmitters 119 and 121 are provided on the feed and exit lines 118 and 120, respectively.

The product system 122 ensures the supply of a product of consistent quality because of the automatic and self-correcting controls provided by the microcomputer based process control system.

In this particular instance where sodium hydrosulfite is the product, the optimum quality product is obtained by controlling the primary product decomposition reactions that can occur to lower yield and increase impurities.

At a pH range of 5–7, the primary decomposition reaction is $$2Na_2S_2O_4+H_2O\rightarrow 2NaHSO_3+Na_2S_2O_3.$$

This is a relatively rapid decomposition, so the addition of caustic to raise the pH to about 12 is essential to the process and one of the key process control loops. The second decomposition reaction of concern occurs at any pH above 7 but, the reaction occurs more slowly the higher the pH is. This reaction is $$3Na_2S_2O_4+6NaOH\rightarrow Na_2S+5Na_2SO_3+3H_2O.$$

The following is the list of sensors in the product flow system 122 that are critical to ensuring product quality as they have been discussed above:

| | Limit 1 | Limit 2 |
|---|---|---|
| Product Conductivity Sensor 117 (millisiemens) | 115 | 95 |
| Product deionized water flow meter 96 (lbs./min.) | 5 | 0.1 |
| Product caustic flow meter 100 (lbs./min.) | — | 0.05 |
| Product temperature 110 (°C.) | 30 | 0 |
| Product flow meter 110 (gal./min.) | — | 0.2 |
| Product density 110 (gms/cc) | 1.2 | 1.13 |
| Product tank level gauge 105 (%) | 100 | 20 |

Process Control

Figure 6A:
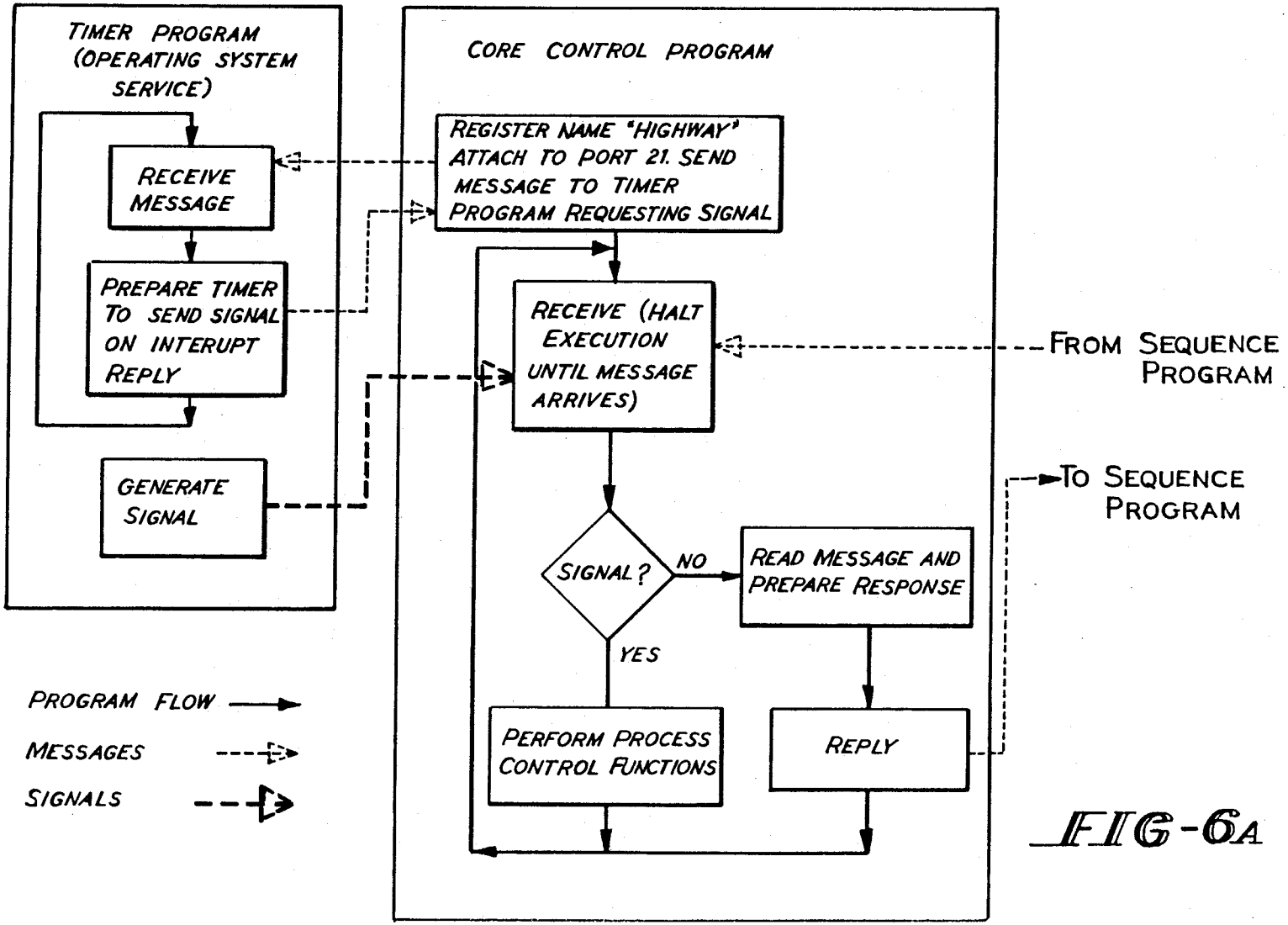
FIGS. 6A and 6B are flow diagrams of four programs utilized in the process control system for an electrolytic cell to permit the four illustrated programs to be concurrently executed in the microprocessor controlled system.
Figure 6B:
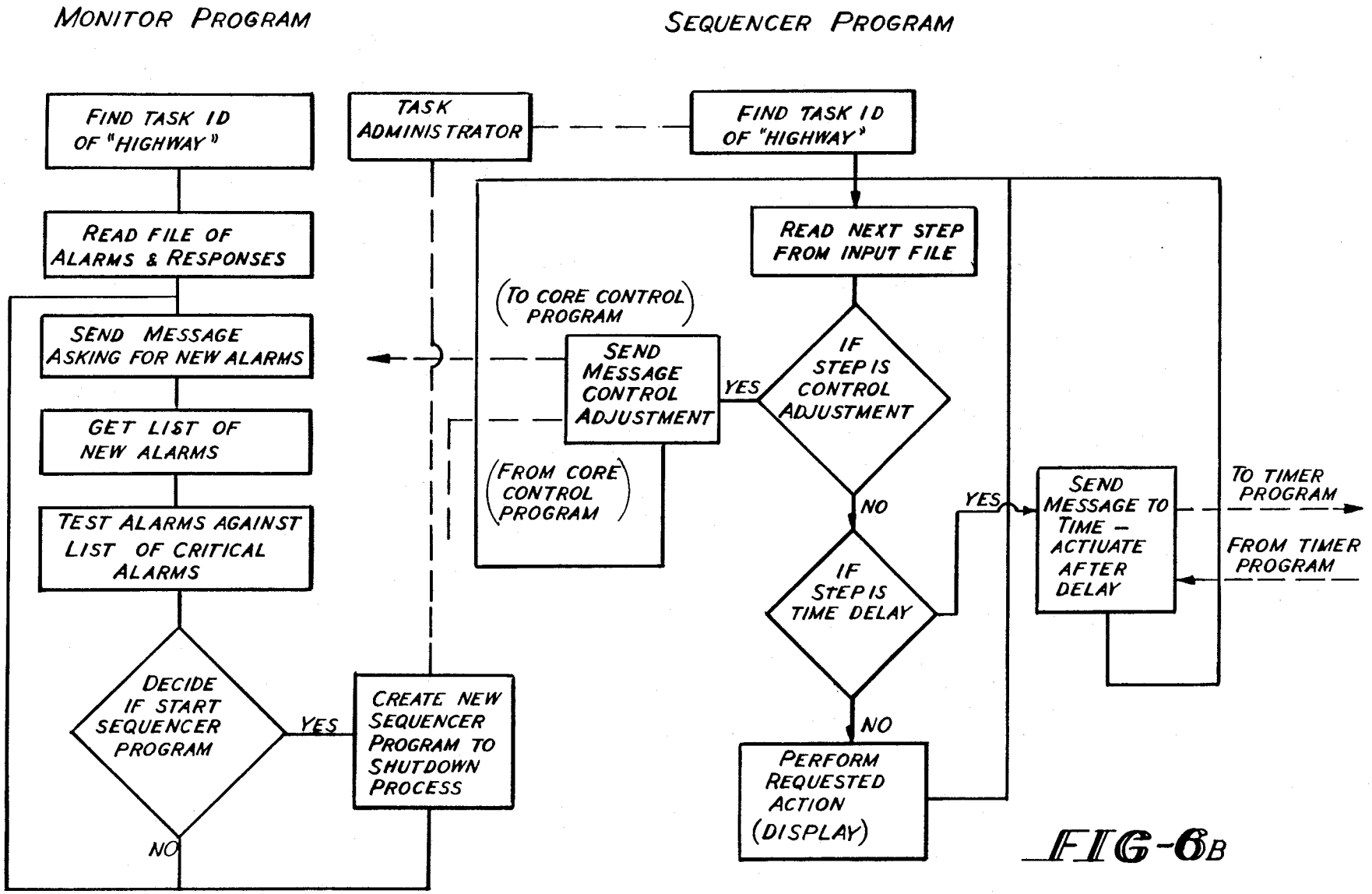

FIGS. 6A and 6B show the multiple programs described previously that are concurrently executed by the microcomputer to insure the automatic process control of the electrochemical production process. The flow chart presented in FIGS. 6A and 6B shows how the sensings are received from the anolyte system 11, the catholyte system 12, and the product system 122 to automatically operate the cell 10 and control the process parameters as previously described.

At the center of the microcomputer based process control system is the core process control program, which is described in FIG. 6A as the core control program. The core process control program centrally monitors the flow of fluids through the electrolytic cell system and compares the actual performance with the desired set points at critical points in the cell process. The core process control program also makes calculations to adjust the actuators or flow control valves.

The core process control program additionally communicates with the timer program to regulate the repeated execution of the routine process control functions previously described. The timer program receives a pulsed signal from hardware in the microcomputer, i.e. a timerchip, to generate a signal that restarts the core process control program to perform the routine process control functions, which have been temporarily halted to allow the alarm monitoring and the sequencer programs to provide their input to the core process control program. For example, the sequencer program provides a new set point, the core process control program reads the new set point message and adjusts the set point. An acknowledgement is sent to the sequencer program of receipt of the new set point and the core process control program awaits receipt of the signal from the timer program to perform the core process control functions with the new set point.

Where out-of-tolerance conditions exist, the core process control program sends a message to the alarm monitoring program that an alarm condition exists. The alarm monitor program identifies those alarms for process conditions which are critical to the operation of the cell system and for which a cell shutdown must be initiated. The alarm monitoring program activates a sequencer program which starts the timer program to start the running of the predetermind time period which is permitted for the core process control program to correct the out-of-tolerance condition. If the out-of-tolerance condition is corrected within the provided time period, the monitor program sends a message to the sequencer program to have the cell shutdown procedure aborted. If the out-of-tolerance condition is not corrected within the time frame the cell shutdown procedure continue. The overall coordinator of the process control system is the task administrator or the operating system in the microcomputer.

In order to exemplify the results achieved with the control of an electrochemical production process, the following examples are provided without an intent to limit the scope of the instant invention to the specific discussion therein.

EXAMPLE 1

A sodium hydrosulfite electrochemical cell of the type shown in FIG. 1, but having 15 bipolar electrodes was operated continuously over a 16 day period without shutdown. The cell operated at about 83.8% current efficiency over the previous 12 hour period of operation. Current was supplied to the cell at about 2.5 $KA/m^2$, or about 1625 amps, and about 46 volts. The catholyte temperature was about 24.5° C., anolyte circulation was about 200 gallons per minute and catholyte circulation was about 205 gallons per minute.

Table 1 illustrates a 10 minute log providing about an 8 hour period of operation with sensings as indicated. The cell current and cell voltage, expressed in amperes and volts, were kept fairly constant during this period. The flow rate of the catholyte, anolyte and product deionized water, all expressed in pounds per minute, show minor variations. For example, the anolyte wate flow decreased during the monitored time, while the product deionized water increase, practically doubling its flow. This increased flow was the result of density readings from sensor 110 being fed to the master flow control loop 97 for the product deionized water to adjust the flow rate set point of the slave loop product deionized water controller 99. this adjustment controls the product's density in the storage tank to the desired level.

The remainder of the units of measure for the values shown in the Table are explained hereafter. Flow rates of the anolyte and product caustic are expressed in pounds per minute and stay within a generally uniform range, except that the product caustic experienced a decrease in flow that corresponds to the product deionized water's increase in flow to attempt to decrease the density of the product. The product flow is mentioned in gallons per minute, while the product density is measured in grams per cubic centimeter. The $SO_2$ flow controller's valve position is expressed as a percentage of movement, while the $SO_2$ measured flow rate is expressed in pounds per minute.

The electrolytic cell 10 was operated over approximately an 8 hour period entirely automatically with the feed rate variations being executed according to the instructions given by the core process control program. Although no out-of-tolerance conditions existed during the monitored period, self-correcting changes were made to insure that the finalized product was of consistent quality.

TABLE 1

| Time | Cell Current | Cell Voltage | Catholyte Deionized $H_2O$ | Anolyte Deionized $H_2O$ | Product Deionized $H_2O$ | Anolyte Caustic | Product Caustic | pH | Product Flow | Product Density | $SO_2$ Flow Controller Valve Position | $SO_2$ Measured Flow Rate |
|---|---|---|---|---|---|---|---|---|---|---|---|---|
| "07:00" | 1625 | 45.216 | 9.9955 | 2.7222 | 0.5096 | 3.1471 | 0.6242 | 5.3171 | 2.0956 | 1.173 | 0.3226 | 2.3948 |
| "07:10" | 1625.3 | 45.2 | 10.009 | 2.7224 | 0.4663 | 3.1397 | 0.5881 | 5.3222 | 2.0578 | 1.1767 | 0.3264 | 2.4034 |
| "07:20" | 1625 | 45.284 | 9.9871 | 2.7222 | 0.4835 | 3.1447 | 0.5852 | 5.319 | 2.0953 | 1.1768 | 0.3268 | 2.4089 |
| "07:30" | 1624.9 | 45.183 | 10.015 | 2.7229 | 0.4346 | 3.1415 | 0.5982 | 5.3209 | 2.0657 | 1.1767 | 0.3277 | 2.4058 |
| "07:40" | 1624.7 | 45.249 | 9.9965 | 2.7225 | 0.4789 | 3.1471 | 0.5807 | 5.3186 | 2.0835 | 1.1768 | 0.3285 | 2.3994 |
| "07:50" | 1624.9 | 45.339 | 9.9978 | 2.7219 | 0.4407 | 3.1405 | 0.6173 | 5.3201 | 2.0601 | 1.1768 | 0.3282 | 2.3974 |
| "08:00" | 1624.6 | 45.267 | 10.018 | 2.7232 | 0.473 | 3.144 | 0.5916 | 5.3215 | 2.0821 | 1.1768 | 0.3306 | 2.4122 |
| "08:10" | 1625.1 | 45.446 | 9.9894 | 2.7219 | 0.526 | 3.1496 | 0.6066 | 5.3174 | 1.9996 | 1.177 | 0.3279 | 2.3881 |
| "08:20" | 1625 | 45.392 | 10.001 | 2.7255 | 0.4295 | 3.1394 | 0.5974 | 5.3215 | 2.0463 | 1.1766 | 0.3274 | 2.393 |
| "08:30" | 1624.9 | 45.576 | 10.01 | 2.7197 | 0.5078 | 3.1458 | 0.5848 | 5.3194 | 2.0685 | 1.177 | 0.3286 | 2.3889 |
| "08:40" | 1625.1 | 45.447 | 10.003 | 2.7222 | 0.5082 | 3.1427 | 0.6077 | 5.3222 | 2.0768 | 1.1768 | 0.3322 | 2.4208 |
| "08:50" | 1625 | 45.606 | 10.008 | 2.7235 | 0.5663 | 3.143 | 0.6174 | 5.319 | 2.0764 | 1.177 | 0.3301 | 2.4009 |
| "09:00" | 1625 | 45.575 | 9.9852 | 2.7219 | 0.5012 | 3.1433 | 0.5878 | 5.3215 | 2.0555 | 1.1766 | 0.3343 | 2.4302 |
| "09:10" | 1625 | 45.521 | 10.005 | 2.7221 | 0.5907 | 3.1495 | 0.5919 | 5.3197 | 2.09 | 1.177 | 0.3321 | 2.4162 |
| "09:20" | 1624.9 | 45.713 | 10.008 | 2.7222 | 0.5157 | 3.1421 | 0.57 | 5.3186 | 2.0169 | 1.1767 | 0.3293 | 2.4015 |
| "09:30" | 1624.9 | 45.491 | 10.002 | 2.59 | 0.5184 | 3.1183 | 0.5977 | 5.3216 | 2.0762 | 1.1768 | 0.3324 | 2.4145 |
| "09:40" | 1625.1 | 45.654 | 9.9996 | 1.9961 | 0.6134 | 3.0006 | 0.6063 | 5.3136 | 2.0695 | 1.1771 | 0.3236 | 2.3474 |
| "09:50" | 1625 | 46.009 | 9.993 | 1.992 | 0.5582 | 2.9958 | 0.5256 | 5.3173 | 1.9602 | 1.1766 | 0.3151 | 2.2975 |
| "10:00" | 1625 | 45.884 | 10.016 | 1.9976 | 0.4876 | 3.0006 | 0.5282 | 5.3196 | 1.9546 | 1.1766 | 0.3315 | 2.2869 |
| "10:10" | 1624.8 | 45.979 | 10.001 | 1.997 | 0.5917 | 3.0039 | 0.5414 | 5.3201 | 1.9944 | 1.177 | 0.332 | 2.3139 |
| "10:20" | 1625 | 46.194 | 10.007 | 1.998 | 0.5503 | 2.9986 | 0.5349 | 5.3202 | 1.9727 | 1.1768 | 0.3269 | 2.3077 |
| "10:30" | 1624.5 | 46.215 | 10.005 | 1.9982 | 0.5832 | 3.0009 | 0.5278 | 5.3186 | 1.9821 | 1.1769 | 0.3256 | 2.292 |
| "10:40" | 1625 | 46.016 | 10.003 | 1.996 | 0.5936 | 3.0013 | 0.5243 | 5.3209 | 1.9761 | 1.1769 | 0.3219 | 2.3168 |
| "10:50" | 1624.8 | 46.149 | 9.9964 | 1.9982 | 0.617 | 2.9934 | 0.5634 | 5.32 | 1.9778 | 1.177 | 0.324 | 2.3095 |
| "11:00" | 1624.5 | 46.163 | 10.01 | 1.9964 | 0.6558 | 3.0055 | 0.5214 | 5.3182 | 1.971 | 1.1769 | 0.3185 | 2.283 |
| "11:10" | 1624.9 | 46.02 | 10 | 1.9989 | 0.6249 | 2.996 | 0.5266 | 5.323 | 1.9662 | 1.1768 | 0.3276 | 2.3173 |
| "11:20" | 1625.1 | 46.045 | 9.9953 | 1.9979 | 0.6728 | 3.0048 | 0.5418 | 5.3203 | 1.9967 | 1.1769 | 0.326 | 2.3223 |
| "11:30" | 1624.9 | 45.877 | 9.9973 | 1.9969 | 0.6977 | 2.9999 | 0.508 | 5.3179 | 1.9751 | 1.1769 | 0.3224 | 2.2836 |
| "11:40" | 1625.1 | 45.635 | 10.001 | 1.9996 | 0.6434 | 2.9962 | 0.529 | 5.322 | 1.9904 | 1.1767 | 0.3293 | 2.3213 |
| "11:50" | 1625.1 | 45.712 | 9.9987 | 1.997 | 0.7451 | 3.0001 | 0.5644 | 5.3198 | 1.9991 | 1.1771 | 0.3269 | 2.3139 |
| "00:00" | 1625.1 | 45.814 | 10.008 | 1.9986 | 0.7895 | 3.0038 | 0.549 | 5.3182 | 1.998 | 1.1771 | 0.3241 | 2.3031 |
| "00:10" | 1624.9 | 45.801 | 9.9905 | 1.997 | 0.8166 | 3.0024 | 0.5245 | 5.3219 | 2.0023 | 1.177 | 0.3295 | 2.3167 |
| "00:20" | 1624.9 | 45.687 | 10.017 | 1.9979 | 0.782 | 2.9984 | 0.525 | 5.3194 | 1.9886 | 1.1768 | 0.3271 | 2.3036 |
| "00:30" | 1624.9 | 45.688 | 9.9814 | 1.9978 | 0.7061 | 2.9973 | 0.5148 | 5.3199 | 2.0018 | 1.1765 | 0.3303 | 2.3227 |
| "00:40" | 1625.1 | 45.766 | 10.017 | 2.005 | 0.782 | 2.9982 | 0.5485 | 5.3184 | 1.9826 | 1.1769 | 0.3276 | 2.2884 |
| "00:50" | 1625.1 | 45.786 | 9.9937 | 1.9957 | 0.7951 | 3.0061 | 0.5017 | 5.3207 | 1.981 | 1.1768 | 0.3296 | 2.3041 |
| "01:00" | 1625.1 | 45.535 | 9.9992 | 1.9982 | 0.7297 | 2.997 | 0.5062 | 5.321 | 1.9964 | 1.1766 | 0.3314 | 2.3206 |
| "01:10" | 1625 | 45.639 | 10.014 | 2 | 0.779 | 3.0006 | 0.5602 | 5.3194 | 1.9954 | 1.177 | 0.3308 | 2.3096 |
| "01:20" | 1625 | 45.764 | 9.9908 | 1.9978 | 0.8383 | 2.9985 | 0.5351 | 5.3215 | 2.0095 | 1.177 | 0.3309 | 2.3196 |
| "01:30" | 1624.9 | 45.836 | 9.9972 | 1.9976 | 0.8182 | 3.0024 | 0.5539 | 5.3173 | 1.9886 | 1.1769 | 0.3268 | 2.2873 |
| "01:40" | 1625.1 | 45.918 | 9.9929 | 1.9969 | 0.9124 | 2.9974 | 0.5446 | 5.3216 | 2.0335 | 1.177 | 0.3319 | 2.3291 |
| "01:50" | 1625.1 | 45.805 | 10.017 | 1.9981 | 0.9359 | 3.0042 | 0.5547 | 5.3183 | 2.005 | 1.177 | 0.3301 | 2.3021 |
| "02:00" | 1625 | 45.709 | 9.9981 | 1.9983 | 0.8983 | 2.9998 | 0.5241 | 5.3208 | 2.0094 | 1.1768 | 0.3318 | 2.3118 |
| "02:10" | 1624.9 | 45.691 | 9.9878 | 1.9983 | 0.9284 | 2.9941 | 0.534 | 5.3202 | 2.0056 | 1.1769 | 0.3313 | 2.3122 |
| "02:20" | 1625.1 | 45.697 | 10.003 | 1.9987 | 0.8989 | 3.0063 | 0.5213 | 5.3208 | 2.0049 | 1.1767 | 0.3345 | 2.3168 |
| "02:30" | 1624.9 | 45.717 | 9.9933 | 1.9976 | 0.9221 | 2.9941 | 0.5678 | 5.3191 | 2.0044 | 1.1769 | 0.3335 | 2.3091 |
| "02:40" | 1624.9 | 45.741 | 10.01 | 1.9973 | 0.9304 | 3.0026 | 0.5331 | 5.3202 | 2.0168 | 1.1768 | 0.3353 | 2.3139 |
| "02:50" | 1624.9 | 45.708 | 9.995 | 1.9983 | 0.9339 | 2.9975 | 0.5518 | 5.3208 | 2.0192 | 1.1768 | 0.336 | 2.3217 |
| "03:00" | 1625.1 | 45.669 | 10.001 | 1.9984 | 0.9662 | 3.0033 | 0.5623 | 5.319 | 1.9424 | 1.1769 | 0.3365 | 2.316 |
| "03:10" | 1625 | 45.756 | 9.9941 | 1.9981 | 0.9124 | 2.9959 | 0.4981 | 5.3191 | 1.9712 | 1.1766 | 0.3324 | 2.2978 |

EXAMPLE 2

The same sodium hydrosulfite electrochemical cell 10 as operated in Example 1 was operated and the following data was obtained under generally the same conditions. Table 2 shows the same parameters being monitored as Table 1 and akes up with the subsequent time read to that monitored in Table 1.

Example 2 illustrates how an automatic cell shut down was initiated immediately without the normal five minute delay after approximately four hours and 30 minutes of operation on this log when the flow in the catholyte $SO_2$ flow loop dropped to zero. At the 08:00 time in Table 2 the cell current average over the ten minute period was almost halved and continued to decrease at the next time increment to reflect the reduction in cell power. Cell voltage was accordingly decreased during this time. The flow rate of the deionized water streams and the anolyte and product caustic flows were decreased to essentially zero shortly therafter. The cell shutdown procedure occurred beyond the eight hour mark of operation in the log when the pH of the catholyte was increased to protect the cathode coatings from the naturally acidic catholyte when the cell current and voltage were decreased. The pH was increased by the decrease of $SO_2$ flow into the catholyte loop and the continued supply of caustic through the anolyte disengager overflow line 68 to the catholyte disengager 18.

The cell shutdown procedure was initiated automatically by the monitor program alerting the sequencer program to start the shutdown process. During the cell shutdown, the circulating pumps continued to operate and the temperature controls remained on. Once the pH was elevated, the power to the rectifier was completely shut off. In sequence, the sequencer and timer programs changed the catholyte current controller current setting to 3% of the available output, turned off the product flow controller and set the product deionized water output set point to zero, turned off the deionized water flow to the product and set the product output set point to zero, adjusted the catholyte deionized water flow rate set point, adjusted the anolyte deionized water set point, adjusted the anolyte caustic set point and once the anolyte system was flooded with deionized water, turned off the deionized water flow and took the power off the rectifier completely after the pH had sufficiently elevated.

An evaluation of the cause of the cell shutdown revealed that the power to the building in which the instrument air compressors for the cell system were housed lost power at about 7:55 PM. This resulted in a loss of power to the instrument air compressors and the pneumatically powered actuators in the system. Hence, all of the pneumatically actuated flow control valves were closed to the shut position, stopping all circulation through the feed line flow control valves in the cell system. The power to the cell was automatically reduced to 3% of the available output by the sequence program to establish a cathodically safe level until the pH was sufficiently elevated to permit the total rectifier shutdown. The monitor program then set the anolyte caustic and the anolyte and catholyte deionized water flow control valves to the proper positions for subsequent start up once the power to the instrument air compressors was recovered.

TABLE 2

| Time | Cell Current | Cell Voltage | Catholyte Deionized $H_2O$ | Anolyte Deionized $H_2O$ | Product Deionized $H_2O$ | Anolyte Caustic | Product Caustic | pH | Product Flow | Product Density | $SO_2$ Flow Controller Valve Position | $SO_2$ Measured Flow Rate |
|---|---|---|---|---|---|---|---|---|---|---|---|---|
| "03:20" | 1624.8 | 45.634 | 10.022 | 1.9995 | 0.9083 | 3.0058 | 0.5131 | 5.3173 | 1.9897 | 1.1767 | 0.3317 | 2.2833 |
| "03:30" | 1624.8 | 45.578 | 9.9812 | 1.9957 | 0.8697 | 2.9935 | 0.5328 | 5.3242 | 2.0033 | 1.1767 | 0.3387 | 2.3331 |
| "03:40" | 1624.9 | 45.697 | 10.018 | 1.9997 | 0.9402 | 2.9999 | 0.5399 | 5.3197 | 2.0057 | 1.177 | 0.3339 | 2.3093 |
| "03:50" | 1624.9 | 45.816 | 9.9786 | 1.9966 | 0.9201 | 3.0014 | 0.5043 | 5.3196 | 2.0269 | 1.1768 | 0.3317 | 2.3225 |
| "04:00" | 1625.1 | 45.815 | 10.006 | 1.9978 | 0.918 | 3.0013 | 0.5253 | 5.3203 | 2.0177 | 1.1768 | 0.3326 | 2.3171 |
| "04:10" | 1625.5 | 45.606 | 9.9988 | 1.998 | 0.8709 | 3.0022 | 0.5488 | 5.3199 | 2.0049 | 1.1767 | 0.3293 | 2.3137 |
| "04:20" | 1624.8 | 45.762 | 10.002 | 1998 | 0.9696 | 2.9981 | 0.5529 | 5.3204 | 2.0105 | 1.1771 | 0.3295 | 2.3172 |
| "04:30" | 1624.8 | 45.818 | 9.9914 | 1.998 | 0.972 | 3.0001 | 0.5528 | 5.3199 | 2.0356 | 1.1769 | 0.3324 | 2.323 |
| "04:40" | 1624.7 | 45.768 | 9.9981 | 1.9982 | 0.967 | 3.0007 | 0.547 | 5.3206 | 2.0166 | 1.1768 | 0.3312 | 2.3177 |
| "04:50" | 1625.1 | 45.718 | 10.009 | 1.9982 | 0.9396 | 3.0009 | 0.5423 | 5.3194 | 1.999 | 1.1768 | 0.331 | 2.3067 |
| "05:00" | 1625.1 | 45.682 | 9.9938 | 1.9982 | 1.0463 | 2.9976 | 0.5608 | 5.3206 | 2.048 | 1.1771 | 0.3348 | 2.328 |
| "05:10" | 1625.3 | 45.711 | 9.9952 | 1.9978 | 0.9838 | 2.9981 | 0.5554 | 5.318 | 2.0083 | 1.1767 | 0.3294 | 2.3046 |
| "05:20" | 1624.6 | 45.706 | 10.011 | 1.998 | 0.9852 | 3.0049 | 0.5415 | 5.3211 | 2.0323 | 1.1767 | 0.3335 | 2.3285 |
| "05:30" | 1625.1 | 45.665 | 9.989 | 1.9981 | 0.9719 | 2.9982 | 0.529 | 5.32 | 2.0048 | 1.1767 | 0.3325 | 2.3105 |
| "05:40" | 1624.9 | 45.44 | 10.014 | 1.9981 | 0.8673 | 2.9961 | 0.5322 | 5.3213 | 2.0148 | 1.1765 | 0.3365 | 2.3285 |
| "05:50" | 1625.2 | 45.595 | 9.9913 | 1.9997 | 1.0227 | 3.0039 | 0.547 | 5.3178 | 2.0211 | 1.1771 | 0.3289 | 2.3077 |
| "06:00" | 1624.9 | 45.844 | 9.9959 | 1.9962 | 0.9914 | 2.9986 | 0.5243 | 5.3218 | 2.0141 | 1.1768 | 0.3298 | 2.3128 |
| "06:10" | 1625.1 | 45.599 | 10.005 | 1.9999 | 0.9192 | 2.9981 | 0.5663 | 5.3194 | 2.0458 | 1.1766 | 0.3345 | 2.3284 |
| "06:20" | 1625.2 | 45.684 | 10.007 | 1.9964 | 1.0055 | 3.0003 | 0.5329 | 5.3182 | 2.008 | 1.1769 | 0.3223 | 2.3014 |
| "06:30" | 1625 | 45.871 | 9.9881 | 1.9973 | 0.9012 | 2.998 | 0.5175 | 5.3225 | 2.004 | 1.1766 | 0.3241 | 2.3282 |
| "06:40" | 1625.1 | 45.795 | 10.004 | 1.998 | 0.9721 | 3.0037 | 0.5335 | 5.3189 | 2.0337 | 1.1769 | 0.3438 | 2.3132 |
| "06:50" | 1625.2 | 45.629 | 10.012 | 1.9979 | 0.9207 | 3.0015 | 0.5564 | 5.3204 | 2.0076 | 1.1768 | 0.3793 | 2.3236 |
| "07:00" | 1625 | 45.805 | 9.9926 | 1.9979 | 0.9476 | 2.9964 | 0.5578 | 5.3195 | 2.0276 | 1.1769 | 0.4263 | 2.2928 |
| "07:10" | 1625.1 | 45.785 | 9.9961 | 1.998 | 0.9454 | 3.0027 | 0.5235 | 5.3229 | 1.9947 | 1.1767 | 0.3975 | 2.3571 |
| "07:20" | 1625 | 45.627 | 9.9998 | 1.9978 | 0.9194 | 2.9969 | 0.5417 | 5.3195 | 2.0084 | 1.1768 | 0.3973 | 2.3518 |
| "07:30" | 1624.9 | 45.793 | 9.9993 | 1.9982 | 0.9313 | 3.0017 | 0.5377 | 5.3208 | 2.0206 | 1.1768 | 0.409 | 2.3569 |
| "07:40" | 1625 | 45.677 | 10.001 | 1.9982 | 0.9112 | 2.9999 | 0.5118 | 5.3195 | 2.0207 | 1.1767 | 0.3794 | 2.3218 |
| "07:50" | 1624.7 | 45.642 | 10.001 | 1.9981 | 0.9081 | 3.0005 | 0.5274 | 5.3199 | 1.9951 | 1.1768 | 0.3827 | 2.338 |
| "08:00" | 888.26 | 32.872 | 5.0913 | 1.1528 | 0.4793 | 1.7128 | 0.2754 | 5.2905 | 1.0598 | 1.1761 | 0.1817 | 1.1838 |
| "08:10" | −15.88 | 15.016 | −0.0011 | −0.0098 | −0.0123 | 0.0112 | −0.0271 | 5.5415 | 0.0198 | 1.1743 | 0 | −0.0034 |
| "08:20" | −36.661 | 3.2237 | 0.0001 | −0.0088 | −0.01 | 0.0075 | −0.027 | 5.5522 | 0.0215 | 1.1747 | 0 | −0.0032 |
| "08:30" | −35.839 | 2.0493 | 0.0016 | −0.0095 | −0.0084 | 0.0075 | −0.0275 | 5.5608 | 0.0218 | 1.1749 | 0 | −0.0022 |
| "08:40" | −34.255 | 1.798 | −0.0005 | 0.6405 | −0.009 | 0.0069 | −0.027 | 5.5622 | 0.0216 | 1.1753 | 0 | −0.0028 |
| "08:50" | −33.81 | 2.4048 | 4.0446 | 1.2091 | −0.0132 | 0.0063 | −0.272 | 8.3183 | 0.0219 | 1.1755 | 0 | −0.005 |
| "09:00" | −32.766 | 2.6958 | 3.5904 | 1.1969 | −0.0097 | 0.007 | −0.0285 | 11.963 | 0.238 | 1.1752 | 0 | −0.0012 |
| "09:10" | −32.188 | 2.6034 | 3.6075 | 1.2028 | −0.006 | 0.0073 | −0.0278 | 12.111 | 0.0233 | 1.1753 | 0 | −0.0018 |
| "09:20" | −30.597 | 2.6593 | 3.5975 | 1.1985 | −0.0064 | 0.0071 | −0.0271 | 12.132 | 0.0228 | 1.1751 | 0 | −0.0035 |
| "09:30" | −30.998 | 2.726 | 3.5976 | 1.1983 | −0.014 | 0.0082 | −0.0261 | 12.154 | 0.022 | 1.175 | 0 | −0.004 |
| "09:40" | −30.275 | 2.7362 | 3.6076 | 1.2016 | −0.017 | 0.0082 | −0.0266 | 12.213 | 0.0213 | 1.175 | 0 | −0.0037 |
| "09:50" | −31.089 | 2.7568 | 3.5957 | 1.2015 | −0.0192 | 0.0085 | −0.027 | 12.252 | 0.0205 | 1.1749 | 0 | −0.0038 |
| "10:00" | −30.296 | 2.7679 | 3.5852 | 1.1992 | −0.018 | 0.0087 | −0.0264 | 12.289 | 0.02 | 1.1749 | 0 | −0.0038 |
| "10:10" | −30.313 | 2.7861 | 3.6012 | 1.1999 | −0.0192 | 0.0085 | −0.0262 | 12.312 | 0.0203 | 1.1748 | 0 | −0.003 |
| "10:20" | −29.944 | 2.8101 | 3.5954 | 1.2002 | −0.0207 | 0.0091 | −0.0261 | 12.338 | 0.0196 | 1.1749 | 0 | −0.0031 |
| "10:30" | −28.841 | 2.8322 | 3.6077 | 1.1999 | −0.0179 | 0.0095 | −0.0263 | 12.365 | 0.0204 | 1.1747 | 0 | −0.0035 |
| "10:40" | −28.017 | 2.8445 | 3.603 | 1.1976 | −0.0172 | 0.015 | −0.0247 | 12.384 | 0.0205 | 1.1747 | 0 | −0.0048 |
| "10:50" | −27.565 | 2.8575 | 3.584 | 1.1997 | −0.0178 | 0.0095 | −0.0255 | 12.398 | 0.021 | 1.1746 | 0 | −0.0043 |
| "11:00" | −26.598 | 2.8843 | 3.5979 | 1.2014 | −0.0163 | 0.01 | −0.0248 | 12.416 | 0.0207 | 1.1745 | 0 | −0.0044 |
| "11:10" | −26.043 | 2.8911 | 3.5995 | 1.2012 | −0.0163 | 0.0109 | −0.0256 | 12.429 | 0.0209 | 1.1749 | −0 | −0.0049 |
| "11:20" | −25.649 | 2.918 | 3.6053 | 1.1985 | −0.015 | 0.0114 | −0.0255 | 12.446 | 0.0227 | 1.1745 | 0 | −0.0046 |

While the preferred structure and method of controlling the process control of the present invention as incorporated and described above, it is to be understood that the invention is not to be limited to the details of the sodium hydrosulfite cell previously presented, but, in fact, it may be employed with any electrochemical cell or automatic process control as required. The scope of the appending claims is intended to encompass all obvious changes in the details, materials, process, control steps which would occurred to one skilled in the art upon reading the disclosure.

What is claimed is:

1. A centralized controller based process control system for the operation of an electrolytic membrane cell to continuously produce an aqueous product solution in the cell which has a cathode compartment, an anode compartment, a cation exchange membrane separating the anode compartment and the cathode compartment, a porous cathode, and a separator intermediate the anode and the membrane, comprising:

(a) a core process control program to control the feed of raw materials to the catholyte in the cathode compartment and to the anolyte in the anode compartment and to maintain the feed within tolerances of desired set points for the rate of feed by initiating self-correcting instructions to actuators controlling the rate of feed of the raw materials, the core process control program also monitoring the product pH to control the product within tolerance of a desired set point and sensing alarm conditions when the rate of feed of the raw materials or the product pH is out-of-tolerance;

(b) an alarm monitoring program to receive sensings of alarm conditions of out-of-tolerance conditions from the core process control program, to analyze the sensings and data on the operation of the cell, and to issue instructions and commands in response thereto;

(c) at least one sequencer program that is put into operation by a command from the alarm monitoring program and which sends commands to the core process control program to initiate a cell shutdown procedure when any predetermined one of the alarm conditions sensed by the core process control program persists beyond a predetermined period of time; and (d) a timer program that is initiated by the sequencer program to initiate timing an out-of-tolerance condition for the predetermined period of time and when the predetermined period of time elapses and the out-of-tolerance condition perists, activating the at least one sequencer program to initiate the cell shutdown procedure.

2. The process control system according to claim 1 wherein the alarm monitoring program screens the sensings of alarm conditions received from the core process control program and identifies predetermined critical alarm conditions that require the cell shutdown procedure to be initiated.

3. The process control system according to claim 2 wherein the core process control program calculates outputs based on sensings to adjust the cell operating conditions to self-correct the out-of-tolerance conditions by adjusting the actuators.

4. The process control system according to claim 3 wherein the actuators are flow control valves.

5. The process control system according to claim 4 wherein the core process control program activates the cell shutdown procedure by decreasing electrical power to the cell.

6. The process control system according to claim 5 wherein the core process control program in the cell shutdown procedure further increases the pH of the catholyte to a safe level so the cathode is not corroded and then further decreases the cell electrical power to the cell shutdown level.

7. The process control system according to claim 6 wherein the catholyte pH is increased to about 12.0.

8. The process control system according to claim 6 wherein the raw materials comprise sulfur dioxide and deionized water to the catholyte and deionized water and caustic to the anolyte.

9. The process control system according to claim 8 wherein the product is an aqueous solution of an alkali metal hydrosulfite.

10. The process control system according to claim 9 wherein the product is an aqueous solution of sodium hydrosulfite.

11. The process control system of claim 8 wherein the catholyte pH is increased by the addition of caustic to the catholyte.

* * * * *